United States Patent [19]

Slysh et al.

[11] 4,015,653

[45] Apr. 5, 1977

[54] PANEL DEPLOYMENT SYSTEM

[75] Inventors: Paul Slysh; LeRoy E. Siden, both of San Diego, Calif.

[73] Assignee: General Dynamics Corporation, San Diego, Calif.

[22] Filed: Apr. 8, 1976

[21] Appl. No.: 675,007

[52] U.S. Cl. ..... 160/213; 244/173

[51] Int. Cl.[2] ..... E06B 3/32

[58] Field of Search ..... 160/213, 130, 188; 244/1, 173

[56] References Cited

UNITED STATES PATENTS

| | | | |
|---|---|---|---|
| 3,477,662 | 11/1969 | Anderson | 244/173 |
| 3,532,299 | 10/1970 | Williamson et al. | 244/173 |
| 3,627,585 | 12/1971 | Dollery et al. | 244/173 |
| 3,677,508 | 7/1972 | Dillard et al. | 244/173 |

*Primary Examiner*—Peter M. Caun

*Attorney, Agent, or Firm*—John R. Duncan

[57] ABSTRACT

A mechanism for deploying and retracting an isogrid structure particularly suited for use in supporting low weight reflective or absorbtive surfaces, characterized by a plurality of hinged isogrid panels stowed in an accordian folded stack arranged for automatic deployment into a long continuous strip or array. Two deployment arms in contact with the stack of panels are rotated to a position perpendicular to the stack, carrying with them the first panels. Thereafter the panels are extended by powered sprockets which engage the panel edges. A shutter bar sequentially releases pairs of panels during deployment. For retraction, the sprockets drive the panels back toward the stack where a creaser bar hinges pairs of panels which are thereafter folded into a stack by means of the shutter bar capturing and stowing each folded pair of panels.

20 Claims, 24 Drawing Figures

10
20
30
40
50
60
a
b
c

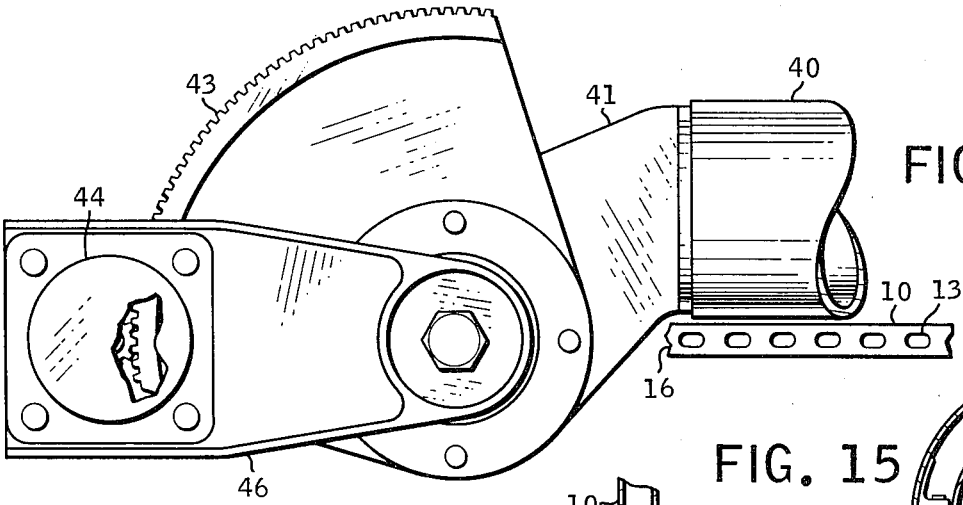
FIG. 13
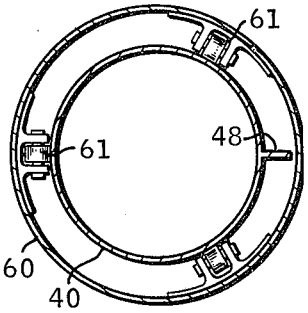
FIG. 15
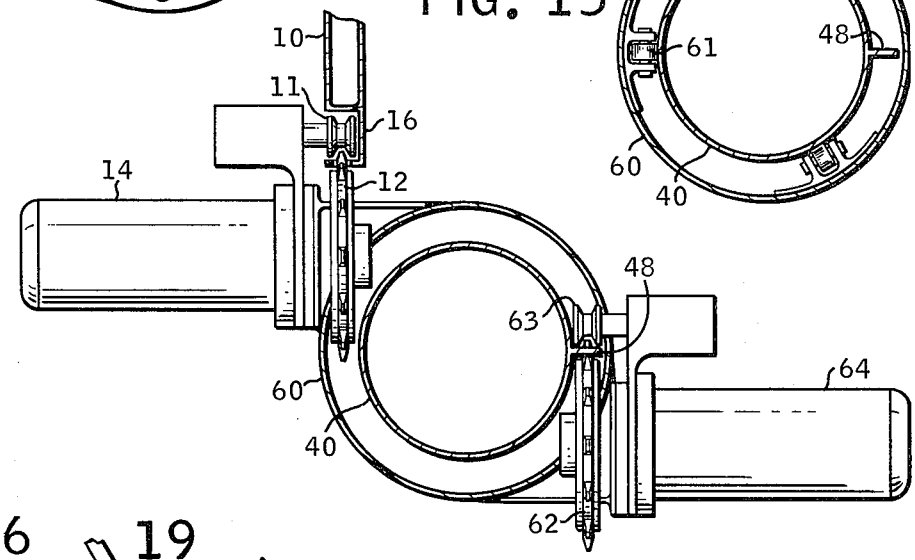
FIG. 14
FIG. 16
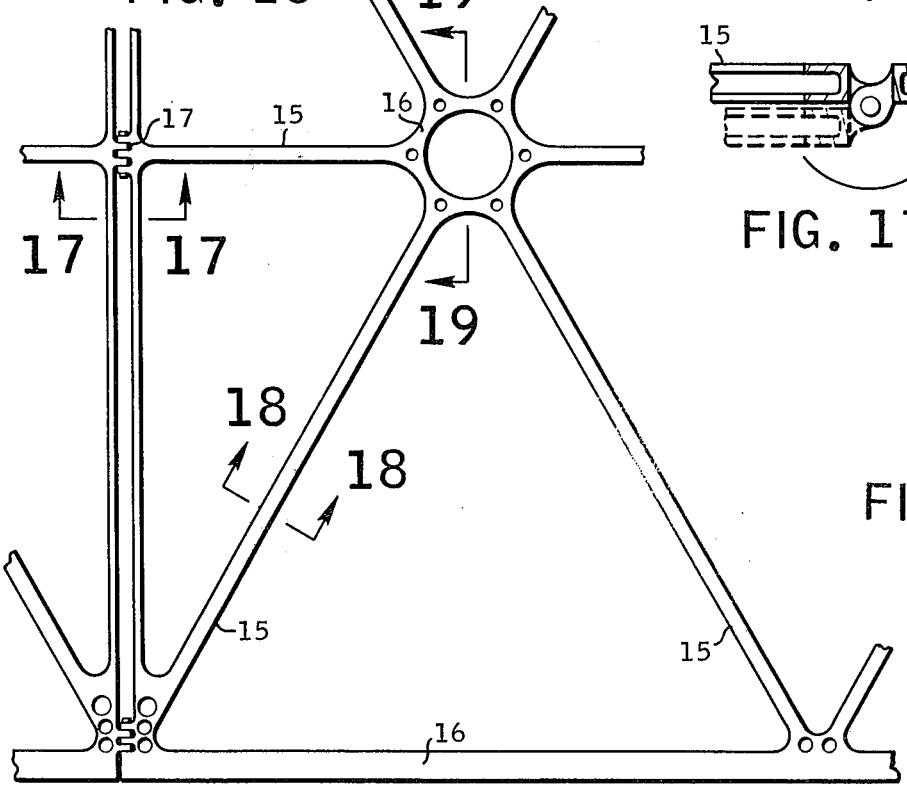
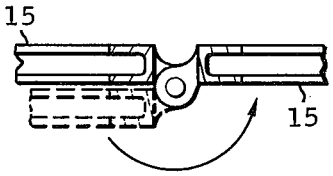
FIG. 17
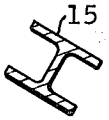
FIG. 18
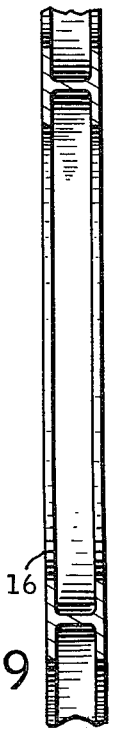
FIG. 19

PANEL DEPLOYMENT SYSTEM

BACKGROUND OF THE INVENTION

A wide variety of mechanisms have been utilized to deploy panels from a storage container into some desired geometric patterned panel or array. Typically such systems are used to deploy radio or radar antennas, solar-cell panel arrays for space craft, solar reflectors, etc. Some existing mechanisms for example utilize telescoping booms of circular or rectangular cross-section which support a flexible panel stored on a drum, and as the drum unwinds the panel is deployed between the two telescoping booms in a window shade manner.

Another mechanism utilizes telescoping booms and stores the panel in an accordian folded pack, deploying the panel between the booms in a similar manner to accordian pleated household drapes being drawn across a window. Other systems use inflatable booms or structures to support an array. In another, accordian folded panels are deployed by applying torque to each of the many panel hinges by means of a run-around cable and pulley system having drums located at each hinge point. In such arrangements the panels are only coplanar upon full deployment, and should the system jamb during deployment the panels would be in a zigzag patterned array. An exception is the earlier described drum deployment system which would have a portion of the window shade array deployed coplanar and useable should the deployment not be totally completed.

Many mechanism and apparatuses for actuating these systems utilize complex and heavy scissor arms, while others use springs for powering the deployment. Springs are heavy for the amount of power they supply, and additionally they do not provide the capability of retracting and re-stowing the array. In order to control the rate of deployment, dash pots are used in conjunction with the springs on some systems, thus reducing even more the power efficiency of the springs.

At least one of the inflatable structures utilizes a thermal setting resin to reinforce the structure and give it a permanent set once it has been deployed, and in still another refinement there is a metallizing of the inflatable structure after deployment. Clearly such systems are not capable of retraction and restowing.

SUMMARY OF THE INVENTION

The present invention provides an improved deployable structure having a foldable panel strip comprised of a plurality of rectangular panels hinged edge-to-edge in such a way that the panels may be folded in accordian fashion to provide a flat stack of minimum stowage volume.

It is an object of this invention to provide a deployment and retraction system overcoming the above noted limitations of existing systems.

Another object of this invention is to provide a deployment and retraction mechanism wherein a majority of all elements serve a structural function in the deployed array, and thereby do not weight penalize the system with a mechanism used only for actuation.

It is another object of this invention to utilize panels that optimize the cantilever and torsional mass stiffness properties of the system by employing lighter first-deployed panels than the last-deployed panels.

It is another object of this invention to eliminate reliance on spring energy and force balances, and to employ a fully positive, fully engaged deployment mechanism. This invention utilizes three basic mechanisms to deploy and retract; the sprocket drive, the creaser arm, and the shutter arm.

The above objects and others are accomplished by the present invention utilizing a new and novel mechanism combination to be now described.

BRIEF DESCRIPTION OF THE DRAWINGS

The advantages of the present invention, which will subsequently become apparent, reside in the construction and operation as hereinafter described, reference being made to the accompanying drawings, showing certain preferred embodiments of the invention, wherein:

FIG. 13 is a side elevation view of the deployment arm drive taken substantially through a plane indicated by line 13—13 in FIG. 23.

FIG. 14 is a sectional view of the crawler drive and panel drive taken substantially through a plane indicated by section line 14—14 in FIG. 23.

FIG. 15 is a sectional view of the inner deployment arm and outer crawler taken substantially through a plane indicated by section line 15—15 in FIG. 23.

FIG. 16 is an enlarged plan view of a portion of one isogrid panel.

FIG. 17 is a sectional view of a panel hinge taken substantially through a plane indicated by section line 17—17 in FIG. 16.

FIG. 18 is a sectional view through a structural grid member of the panel indicated by section line 18—18 in FIG. 16.

FIG. 19 is a sectional view of a panel node taken through a plane indicated by section line 19—19 in FIG. 16.

DETAILED DESCRIPTION OF THE INVENTION

Figures 1, 2, 3, 4, 5, 6, 7, 8, 9, 10:
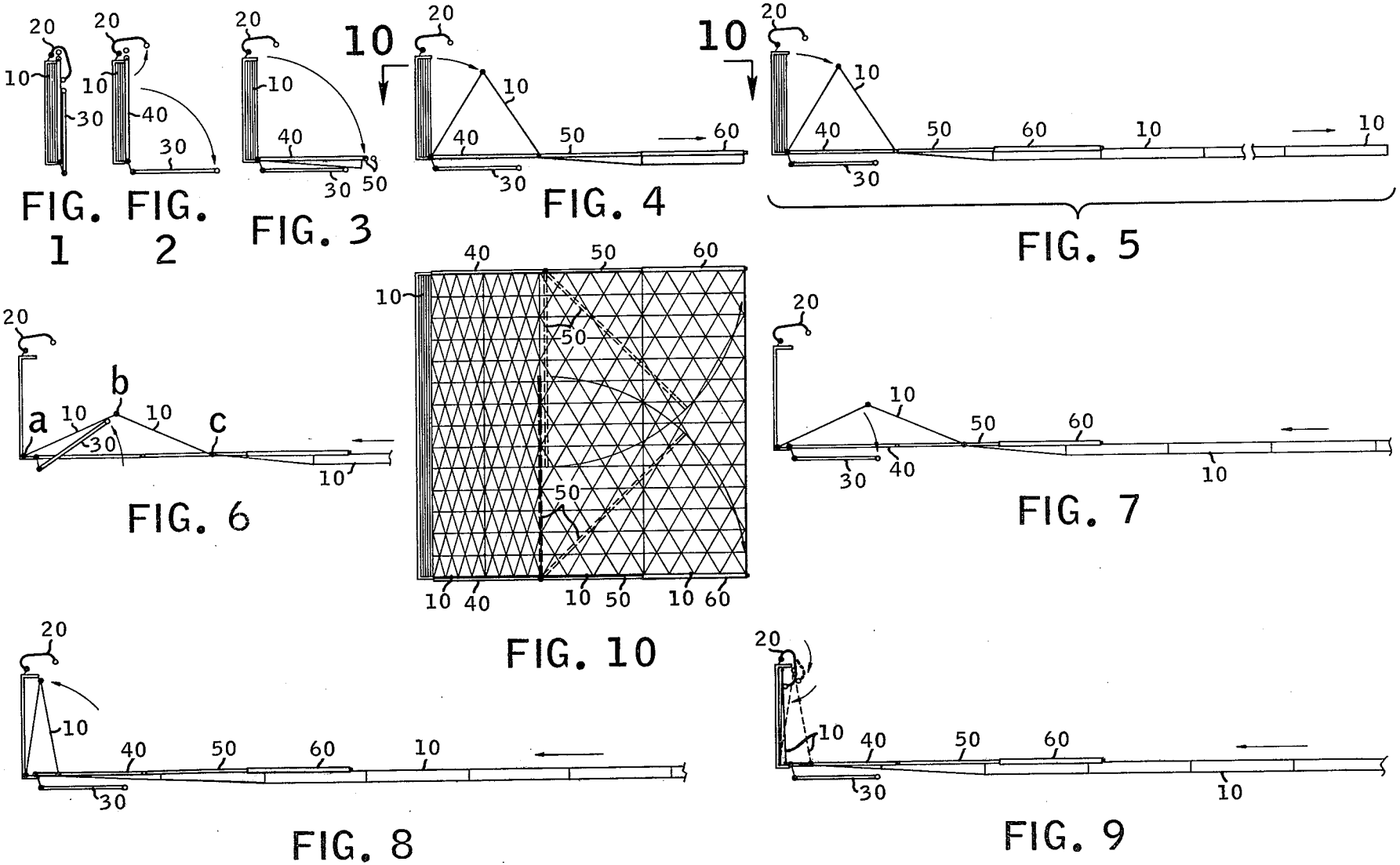
FIGS. 1 through 5 are schematic presentations of the sequential steps of deploying the panels.
FIGS. 6 through 9 are schematic presentations of the sequential steps of retracting the panels.
FIG. 10 is a plan view of the panels taken substantially through a plane indicated by line 10—10 in FIG. 4.

Referring now to the drawings in detail, FIG. 1 illustrates schematically a side view of the system in the stowed position. A plurality of panels 10, are folded in an accordian fashion and retained in this position by the shutter 20, and the creaser 30. In FIG. 2 the shutter 20, and the creaser 30 have been rotated to open positions, and the deployment arms 40 are now seen to be also holding the panels 10 in their stowed position.

In FIG. 3, the deployment arms 40 have rotated downward to the open position, and in FIG. 4 the deployment arms are fully extended. This additional extension was accomplished by a second set of deployment arms 50 rotating in a horizontal plane about their hinged attachments to arms 40, as shown in FIG. 10. Additionally it will be observed that crawler 60 has traversed deployment arms 40 and 50 and is now located along the far end portion of deployment arm 50. Crawler 60 also carried with it the first of the panels 10. Thus the first panels 10 are in a horizontal position between the deployment arms 50, while a following pair of panels 10 are out of the stowed position and have assumed a jack-knife position.

In FIG. 5 it will be seen that additional panels 10 have been deployed and are being supported in a cantilever manner by arms 40 and 50. These panels were deployed by means of sprocket drives located within the crawler 60. The sprockets engage slots located along the edge of the panels and rotation of the sprockets extends the panels in a manner similar to a motion picture projector drive arrangement.

It should be noted that the description and illustrations of these operations has been extremely brief and simplified, and parts have been eliminated in the illustrations in order that an overall understanding of the invention may be had before a more detailed disclosure is undertaken. In a like manner a brief description of the retraction cycle will be made before the invention is fully disclosed.

In FIG. 6 the sprocket drives have been actuated in the retraction mode, and the creaser bar 30 has rotated upward, displacing the last two panels of the array into a jack-knife position. The shutter 20 is in the open position.

In FIGS. 7 and 8 the creaser bar 30 has rotated downward while the sprocket drives located in the crawler 60 have continued to move the plurality of panels toward the stowed position causing one pair of panels to assume a jack-knife position of ever decreasing included angle. When this pair of jack-knifed panels has progressed sufficiently, the shutter 20 rotates, as shown in FIG. 9, and pushes the pair of panels into the fully accordian folded stowed position. The shutter 20 then rotates to the open position, and the creaser bar 30 rotates upward, as shown in FIG. 6, to jack-knife a second pair of panels, and the sequence shown in FIGS. 6 through 9 is repeated over and over again until the first panel is retracted into the crawler 60, as shown in FIG. 4, whereupon the deployment arms are stowed in the sequence illustrated in FIGS. 4 through 1.

Figure 11:
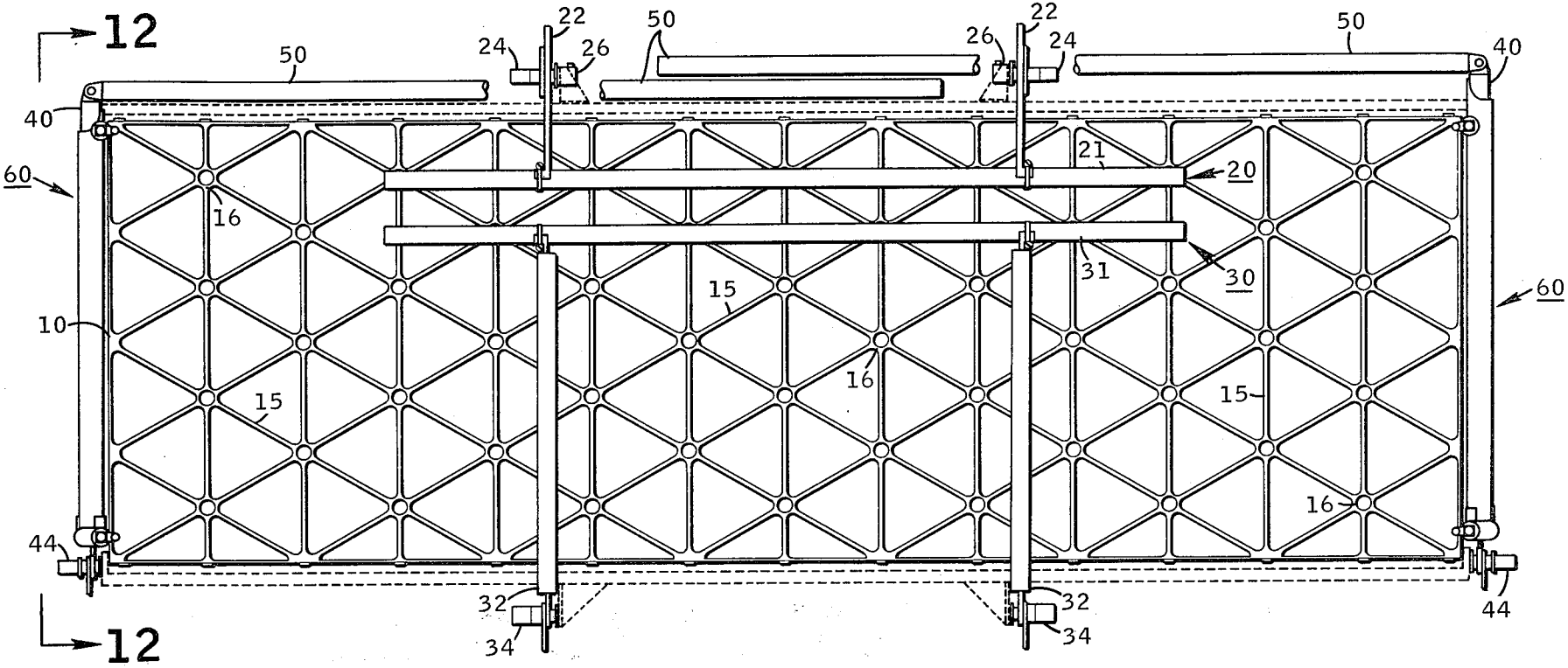
FIG. 11 is a front elevation view showing the general arrangement of the system.
Figure 12:
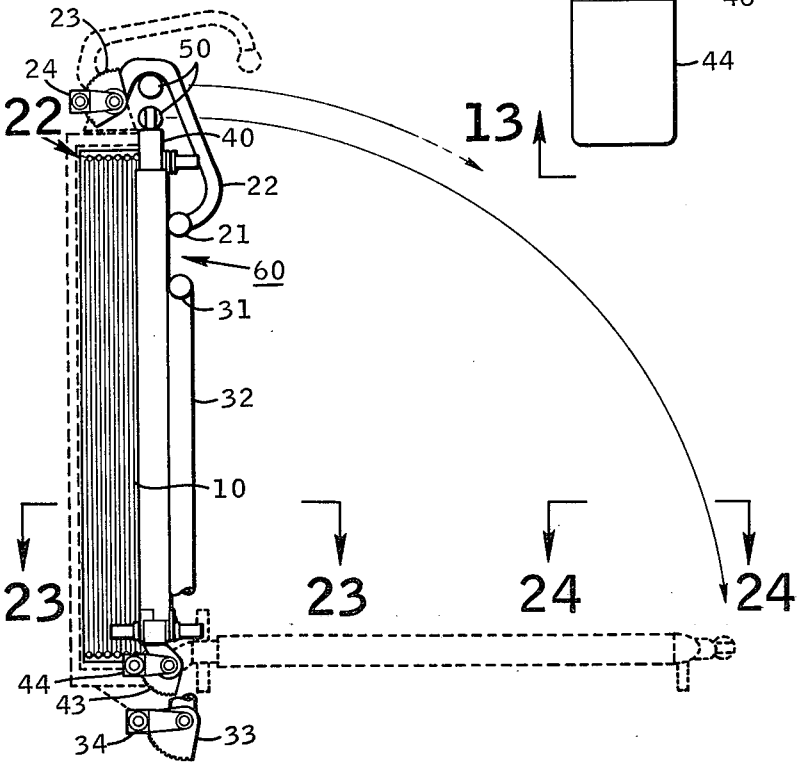
FIG. 12 is a side elevation view taken substantially through a plane indicated by line 12—12 in FIG. 11.

Referring now to FIGS. 11 and 12, wherein a plurality of panels 10 are stacked in the flat folded position, it will be noted that shutter 20 is retaining the panels in the stack. Shutter 20 comprises a shutter bar 21 attached near each end to shutter arms 22 which are rotatably attached to a support structure, not shown. Rotation of the shutter arms 22 is accomplished by means of gear sectors 23 and drive motors 24. Creaser 30 comprises a creaser bar 31 attached near each end to creaser arms 32 which are rotatably attached to a support structure, not shown, and which are rotated by means of gear sectors 33 and drive motors 34.

Figure 23:
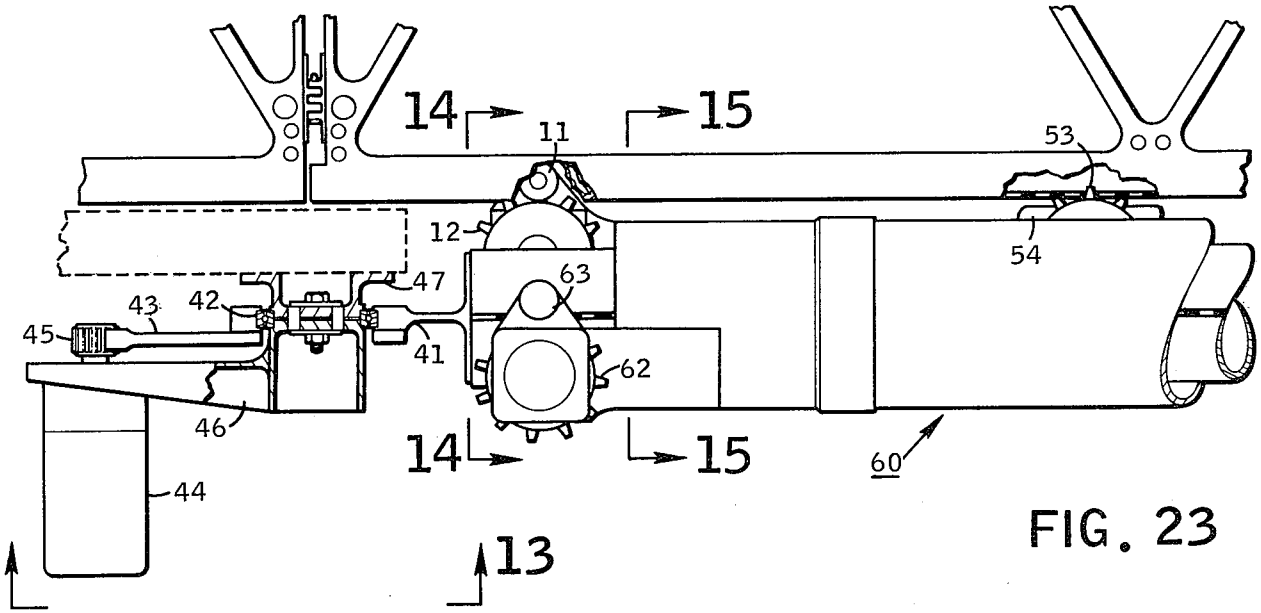
FIG. 23 is a plan view of a portion of a deployment arm taken substantially through a plane indicated by line 23—23 in FIG. 12.

Deployment arms 40 are disposed at each end of the panels 10 in a vertical position and each deployment arm 40 is hingedly attached at the top end to a deployment arm 50. The two deployment arms 50 are stowed horizontally above the top edges of panels 10. A crawler 60 is disposed around each deployment arm 40 in a manner such that only the top end of deployment arms 40 extend beyond crawlers 60 and are visible. The lower end of each deployment arm 40 is rotatably attached to a support structure, not shown, and rotation is accomplished by means of gear sectors 43 and drive motors 44. In FIGS. 23 and 13 one of the gear sectors 43 and drive motors 44 may be more clearly seen. Attached to motor 44 is a pinion gear 45 which is engaged with gear sector 43. This relationship is maintained by means of motor support fitting 46, which is attached to structure support fitting 47 and journaled in bearing 42. Gear sector 43 is attached to deployment arm endfitting 41. Any suitable means of attaching these parts together may be utilized such as riveting or welding, it however being the preferred method to use bolts and shear pins for precision alignment and ease of disassembly should repairs ultimately be required. The gear sectors 23 and 33 and drive motors 34 and 44 for actuating the shutter 20 and creaser 30 are arranged and mounted substantially the same as sectors 43 and motors 44.

Referring now to FIG. 15 it will be observed that deployment arm 40 is of tubular cross section and that crawler 60 is also of tubular cross section and fits over deployment arm 40 to form a telescoping arrangement wherein the crawler 60 is supported by means of a plurality of rollers 61, disposed in sets of three rollers equally spaced circumferentially around deployment arm 40. Four such sets or rollers 61 for a total of twelve rollers are so located within crawler 60. A rack 48 is located longitudinally along deployment arm 40. This rack may be of the conventional gear and rack arrangement wherein spur gear teeth are disposed along the surface of the rack. However in the preferred embodiment wherein metal thicknesses of the deployment arm 40 and crawler 60 are of very light gage, it is preferred to utilize slots disposed along the entire length of the rack 48, arranged for engagement with a sprocket as shown more clearly in FIG. 14. Here it will be seen that rack 48 is captured by roller follower 63 on one side and a sprocket 62 on the opposite side with the teeth of sprocket 62 engaged through rectangular slots in rack 48. Translation of crawler 60 along deployment arm 40 will occur upon actuation of crawler drive motors 64. In a similar manner the panel 10 is captured by a follower 11 and a sprocket 12 which engages the upstanding edge leg of channel section 16, forming the edge of panel 10 and having similar rectangular slots 13 disposed therein as shown in more detail in FIG. 13. The arrangement of the panel drive and crawler drive shown in FIG. 14 is duplicated at the opposite end of crawler 60.

Figure 24:
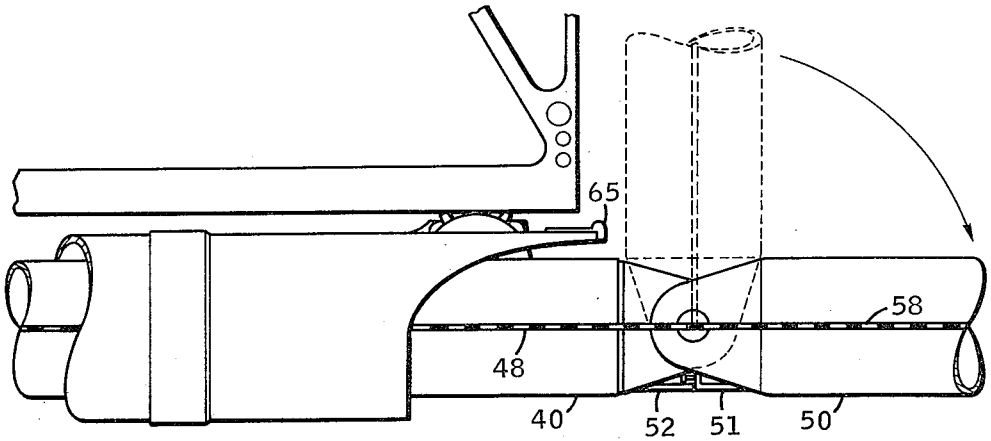
FIG. 24 is a plan view of a portion of a deployment arm taken substantially through a plane indicated by line 24—24 in FIG. 12.

Referring to FIG. 24, wherein a portion of deployment arm 50 is shown, it will be noted that a rack 58 is located longitudinally along arm 50 and in alignment with rack 48 of deployment arm 40. Rack 58 is configured in the same manner as rack 48, having rectangular slots disposed thereon for engagement of sprockets 62. Located on the crawler 60 near the hinged attachment of deployment arm 40 and deployment arm 50 is a bumper 65. Upon initial movement of crawler 60 along deployment arm 40, the bumper 65 will engage the stowed arm 50 (shown by phantom lines), which is biased to the stowed position. Advancing the crawler 60 further along arm 40 will overcome the bias of the stowed arm 50 and cause it to rotate to the deployed position (shown by solid lines). When arm 50 is fully rotated to the deployed position, stops 51 and 52 prevent further rotation of arm 50. With the racks 48 and 58 in alignment, the crawler 60 will traverse from arm 40 to arm 50 by means of the two sprockets 62 located at opposite ends of each crawler 60, and because there are two sprockets, continuous movement of the crawler across any discontinuity of racks 48 and 58 is insured. The support rollers 61 (FIG. 15) provide linear guidance, and the racks 48 and 58 and sprockets 62 provide angular restraining between each crawler 60 and its respective deployment arms 40 and 50 as the crawler traverses these arms. When the crawlers 60 have each approached the end portion of their respective deployment arms 50, power is removed from the crawler sprocket drive motors 64 and applied to panel sprocket drive motors 14 by means of a limit switch (not shown) mounted near the end of each deployment arm 50. Limit switches and their use to limit a mechansims motion by making and breaking electrical circuits are well known to those skilled in the art, and such limit switches are employed to also provide electrical intelligence to the deployment motors 44. All such electrical limit switches have not been shown for clarity. Encoders, to be later described, provide intelligence to the shutter motors 24 and the creaser motors 34.

It will have been observed that the first panel 10 was engaged to crawler 60 by means of the two sprocket drives 12 disposed on each crawler 60, such that when deployment arms 40 were rotated to a horizontal position, as shown in FIG. 3, the first panel 10 was rotated out of the vertical stack of panels with deployment arms 40. Additionally, the first panel 10 was carried by crawlers 60 as the crawlers traversed the length of deployment arms 40 and 50, to the position shown in FIG. 4 where it will be seen that the second and third panels 10 are also in a horizontal plane, and the fourth and fifth panels 10 are out of the vertical stack and have assumed a jack-knife position. Thus it will be understood that the first five panels have been removed from the vertical stack of panels by means of movement of crawlers 60. Subsequent panel deployment is by drive motors 14 rotating sprockets 12 and thereby driving each succeeding panel out beyond the crawler 60, as shown in FIG. 5, until all panels have been removed from the vertical stack and are disposed along a substantially horizontal deployment plane. As has been described, translation of each of the two crawlers 60 is derived from two motors 64, and actuation of the panels is derived from two other motors 14 mounted on each crawler 60. These four motors mounted on each crawler 60 are d.c. gear head motors which drive their respective sprockets through tandem slip clutches and are of a type well known to those skilled in the art.

Referring now to FIGS. 11 and 16, it will be observed that panel 10 is an extremely light isogrid structure comprised of a plurality of grid members 15 arranged in a pattern of contiguous isosceles triangles and joined at their corners by circular nodes 16. A cross-section of a grid member 15 is shown in FIG. 18, and a cross-section of a node 16 is shown in FIG. 19. It should be appreciated that for some structural applications the cross-section of grid members 15 may be a T section, Z section, or a channel section, as may be required to support whatever surface is mounted thereon; however the I section illustrated in FIG. 18 is the preferred section for symmetrical stiffness and spring constant properties in the plane of the panel. Certainly in most instances at least one web and one cap is desired, such as a T section. This panel structure is adaptable to supporting a solar panel substrate on which solar cells are mounted, for supporting light reflective or radio frequency reflective materials, or other desired surface material.

Weight of this open isogrid structure is a function of grid member thicknesses and node-to-node spacing, and in most cases the structural strengths and stiffnesses compare superior, as do weights, to honey-comb sandwich construction usually employed for such applications. Where extremely light structures are required, isogrid panels have been produced from aluminum alloy where the wall thickness of grids 15 were 0.004 inch. The grids were first machined to a wall thickness of 0.050 inch and then chemically milled to the required 0.004 inch thickness. As an example of the extreme lightness of this open isogrid structure, a panel having 16 inch node-to-node spacing, a 0.25 inch panel thickness and grid widths, and wall thicknesses of 0.004, weighs about 0.01 pounds per square foot, or 100 square feet would weigh approximately one pound.

Figure 20:
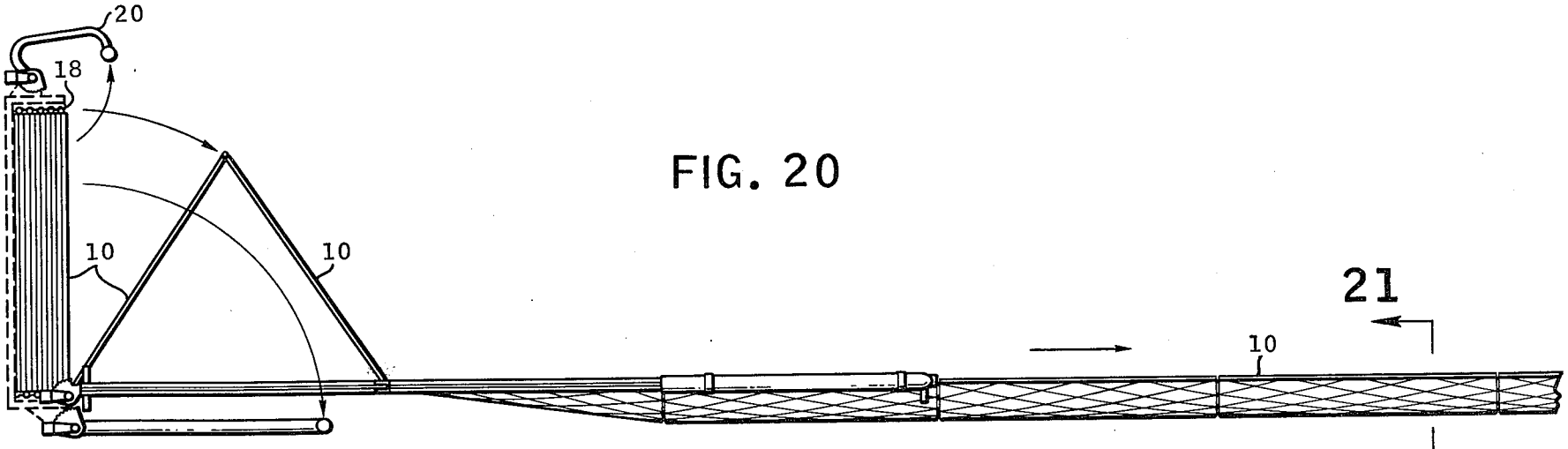
FIG. 20 is a side elevation view showing the system during deployment, wherein some of the panels are deployed and others are in the stowed position.
Figure 22:
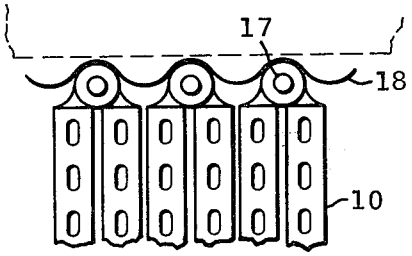
FIG. 22 is a partial view of the alternately folded panels in the stowed position showing the restraining snake spring.
Figure 21:
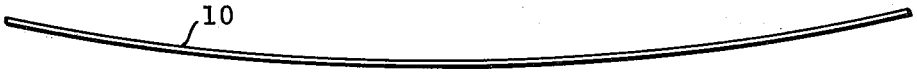
FIG. 21 is a sectional end view taken through one of the panels in a plane indicated by line 21—21 in FIG. 20.

Hinge fittings 17 are located along each of two opposite edges of panels 10 at the intersections of grid members 15 and are adapted to provide at least 180° relative movement between panels, as shown in FIG. 17. The panels 10 are hinged together by means of these hinge fittings 17 to fold in alternate directions with respect to one another. When fully deployed the panels lie in a common plane as shown in FIG. 20 and assume the cross-sectional curvature shown in FIG. 21, forming a structurally stable configuration similar to the extended carpenters steel rule. This preformed curvature, giving each panel a leaf-spring characteristic, can only exist in a panel when it has become coplanar with other deployed panels. In the stowed position this uni-directional curvature is fully removed by mutual reaction at hinges 17 between abutting panels. In the stowed position the alternate folding of panels causes the uni-directional curvature preload in each pair of back-to-back panels to mutually cancel out, and the hinge line is a straight line. It is only when this pair of panels rotate into a common plane that the hinge restraint is removed and the panels may assume a mutual curvature. Upon retraction, the creaser bar 31 rotates upward with sufficient force to overcome the curvature preload in the panels and again cause the hinge line to become straight. In the stowed state each pair of panels 10 are restrained by means of a snake spring 18, located as shown in FIG. 20 and 22. Upon the retraction of each pair of panels the shutter bar 21 is rotated down to push this pair of panels past the lobes of snake spring 18 until the pair of panels are flat against the previously stowed panels to form a flat stack as shown in FIG. 12.

Referring again to FIG. 11 it will be noted that a shaft encoder 26 is mounted opposite each of the two shutter drive motors 24. This shaft encoder 26 is used for detecting the angular sweep of shutter arm 22. In FIG. 23 there is shown an idler sprocket 53 and an encoder 54 arranged similar to the panel drive sprocket 12 and motor 14 to engage the slots 13 located along the edge of panels 10. The encoder 54 senses the deployed/retraction status of the panels, and this data is processed by simple flip-flop logic to initiate shutter arm and creaser arm actions. For example when the array is being retracted, creasing cause rotation at three panel hinges simultaneously (hinge joints *a*, *b*, and *c* of FIG. 6). The encoder 54 senses when the crease farthest away from the stack (hinge joint C of FIG. 6) is approaching the stowed position and will initiate a cycle of the shutter bar 21 to capture the creased pair of panels and force them into their stowed position. When the creased panels have been stowed, and the drive clutches of panel drive motors 14 are slipping, the shutter encoder 26 indicates the proper angular sweep of shutter arm 22 has occurred, and the logic initiates a movement of the creaser bar 31 to recycle the panel folding and stowing process. In a similar manner during deployment, coordinated movements of the shutter 20 and the panel drive sprockets 12 cause the shutter 20 to cycle open and close to permit passage of one pair of panels at a time for subsequent deployment by the panel drive sprockets.

At the time a pair of panels is stowed and before the creaser has recycled, the panel drive motor clutches are slipping as previously described. This driving force on the panels induces counter acting moments on the deployed array to leave the array substantially undisturbed by the creasing process. This is understood by recognizing that the sprocket drive forces on the edges of the curved deployed panel array act with respect to the centroidal plane of the array to counteract the moment created by the creaser bar. It therefor is desirable that the sprocket drive forces, available by means of the slipping clutches, are present at the time the panels are being creased.

From the foregoing description the operation of the disclosed system may be understood. The deployment arms 40 are rotated to open positions after the shutter 20 and creaser 30 are opened, these operations being accomplished by motor driven sector drives. The longer deployment arms 50, pivotally attached to the shorter deployment arms 40, are rotated horizontally by a bumper carried by crawlers 60 as they advance along deployment arms 40. After the crawlers have advanced to the ends of deployment arms 50, the crawlers are stopped and the panel drive sprockets 12 are actuated. Subsequent panels are deployed by coordinated movements of the shutter bar 31 and panel drive sprockets. To retract the deployed panels the panel drive sprockets 12 are actuated in a reverse direction and the creaser bar 31 acts to crease the two panels closest to the stowage volume. The sprocket drives now continue to retract the two panels, and when the upper crease is in reach of the shutter bar 21, the bar acts to capture the panels and force them into the snake spring 18 to the back end of the storage volume. When this is accomplished the drive sprockets 12 are momentarily stopped by means of their slipping clutches until the creaser bar 31 creases the next pair of panels. Subsequent panel retractions are accomplished by repeating the cycle thus described.

The flexibility of the open isogrid structured panels 10 in the plane of the panel permits creasing action well within the elastic range of the panel material. The characteristics of isogrid structures for broad scale strain redistribution are used to insure no excessive local straining of whatever surface is mounted to the isogrid panels. Open isogrid structured panels allow larger back radiation from the surface mounted thereon than most other panel constructions, and the open structure permits access to the back side of the mounted surface for attaching components or for repair.

Low compliances with respect to forces in the plane of the panels are desirable to obtain maximum deployed structural rigidity, however compliances must be adequate to insure that creasing forces to overcome hinge restraints do not yield the isogrid structure or excessively strain the solar-cell substrate, reflective material, or other surface that may be carried by the isogrid structure.

The isogrid node-to-node spacing, grid cross-sections, node diameters and sprocket drive edge fixity are all variables that may be altered to obtain the desired performance for a particular sized panel structure and deployment mechanisms. Other arrangements, modifications, and applications of the invention will become apparent to those skilled in the art upon reading the present disclosure, and these are intended to be included within the scope of the invention, it being understood that the preceding description is by way of example and is not to be taken as a limitation, the spirit and scope of this invention being limited only by the appended claims.

We claim:

1. A deployable structure comprisng:

a plurality of panels hingedly connected together in end-to-end relation and alternately folded into an accordion folded stack;

deployment arms, each having a free end and a rotatably fixed end, said deployment arms disposed adjacent to said stack;

at least one crawler engaged with one of said deployment arms and engaged with one of said panels;

a deployment drive for rotating said deployment arms to a position substantially perpendicular to said stack;

a crawler device for translating said crawler along the longitudinal length of said deployment arm; and a panel drive disposed on said crawler for linear movement of said panels in a deployment plane substantially coplanar with said rotated deployment arms, causing said panels to alternately unfold from said accordion folded stack.

2. A deployable structure according to claim 1 wherein said crawler drive comprises a rack and pinion.

3. A deployable structure according to claim 2 wherein said panel drive comprises a rack and pinion.

4. A deployable structure according to claim 2 wherein said panel drive comprises a perforated strip and a sprocket for engaging said perforated strip.

5. A deployable structure according to claim 1, including a shutter disposed adjacent to said stack, said shutter articulated in such manner that only one pair of folded panels at a time are removed from said stack.

6. A retractable structure comprising:

a plurality of panels hingedly connected together in end-to-end relation to form a continuous strip, said strip disposed in a deployed plane;

deployment arms, each having a free end and a rotatably fixed end, said deployment arms disposed adjacent to said panels;

a creaser disposed adjacent to said panels, said creaser articulated in such manner to hinge one pair of panels at a time into a jack-knife position;

a panel drive for moving said panel strip longitudinally along said deployed plane each time said creaser hinges a pair of said panels; and biasing means for folding each jack-knife positioned pair of panels into a flat stack.

7. A retractable structure according to claim 6, wherein said biasing means comprises a shutter disposed near the apex of said jack-knife positioned panels.

8. A retractable structure according to claim 6, further comprising a retraction drive for rotating said deployment arms into a position substantially parallel and adjacent to said flat stack.

9. A retractable structure according to claim 6, wherein each of said panels comprises a plurality of grid members arranged in a pattern of contiguous isoceles triangles joined together at each juncture by circular nodes.

10. The structure of claim 9, wherein each of said grid members is comprised of at least one web and one cap.

11. The structure of claim 6, wherein said panels are shaped to have uni-directional curvature in a lateral direction of said continuous strip.

12. A moveable structure comprising:

a plurality of rectangular panels hingedly interconnected together for accordion-like folding and unfolding disposed in an accordion folded stack;

deployment arms stowed adjacent to opposite ends of said stack, each of said deployment arms having a free end and a rotatably fixed end;

a crawler mounted on each of said deployment arms near said rotatably fixed end;

a shutter disposed along a top edge of said stack and bearing against said stack, holding the stack in a compressed state;

a deployment drive for rotating said deployment arms to a deployed position substantially perpendicular to said stack;

a crawler drive for translating said crawlers along each of said deployment arms from said fixed ends to the proximity of said free ends when the deployment arms are in said deployed position;

a panel drive for removing folded panels from said stack by unfolding pairs of said panels until each pair of panels are coplanar, and subsequently translating said panels substantially along the longitudinal axis of said deployment arms away from said stack to form a deployed plane; and a shutter drive for opening and closing said shutter to limit travel of panels toward and away from said stack to one pair of panels at a time.

13. The moveable structure of claim 12 further comprising:

a creaser bar parallel to one of said panel hinges disposed within said deployed plane;

a creaser drive for moving said creaser bar against and away from said panels, hinging one pair of panels at a time out of said deployed plane into a jack-knife position; and wherein said panel drive is adapted to cause said panels to translate toward said stack and closing each pair of jack-knifed panels until captured by said shutter.

14. The moveable structure of claim 13 wherein:

said crawler drive is adapted to cause said crawlers to translate along said deployment arms to the proximity of the rotatably fixed ends of said deployment arms; and said deployment drive is adapted to cause said deployment arms to rotate to said stowed position adjacent to said panel stack.

15. The moveable structure of claim 13 further comprising an encoder for detecting the position of said panels to initiate creaser bar drive and shutter drive.

16. The moveable structure of claim 12, wherein said crawler drive comprises a rack attached to said deployment arm and at least one sprocket rotatably mounted in said crawler.

17. The moveable structure of claim 12, wherein said panel drive comprises racks attached to a plurality of said panels and at least one sprocket rotatably mounted in said crawler.

18. The moveable structure of claim 12 further comprising an encoder for detecting the position of said shutter.

19. The moveable structure of claim 12, wherein said shutter comprises a shutter bar shaped to bear against panels folded in said stack, and at least one shutter arm attached by one end to the shutter bar and rotatably mounted at the other end to define an articulated motion of the shutter bar away from and toward the stack.

20. The structure of claim 12, wherein a plurality of said panels are formed to have uni-directional curvature in the lateral direction in said deployed plane, giving each panel so curved a leaf-spring characteristic to resist hinging out of the deployed plane, and wherein each panel is comprised of a plurality of grid members arranged in a pattern of contiguous triangles joined together at each juncture by structural nodes.

* * * * *